US010774579B2

(12) United States Patent
Harrison

(10) Patent No.: US 10,774,579 B2
(45) Date of Patent: Sep. 15, 2020

(54) TWIN LOUVER WINDOW ASSEMBLY FOR EFFICIENT THERMAL CONTROL

(71) Applicant: Breezway Australia Pty Ltd, Coorparoo, Queensland (AU)

(72) Inventor: Steven Ian Harrison, Bulimba (AU)

(73) Assignee: JELD-WEN, INC., Charlotte, NC (US)

( * ) Notice: Subject to any disclaimer, the term of this patent is extended or adjusted under 35 U.S.C. 154(b) by 196 days.

(21) Appl. No.: 15/484,957

(22) Filed: Apr. 11, 2017

(65) Prior Publication Data

US 2017/0292319 A1 Oct. 12, 2017

(30) Foreign Application Priority Data

Apr. 11, 2016 (AU) ..... 2016901343

(51) Int. Cl.

| | |
|---|---|
| ***E06B 7/092*** | (2006.01) |
| ***E06B 3/50*** | (2006.01) |
| *E05F 15/71* | (2015.01) |
| *E05F 15/77* | (2015.01) |
| *E05F 15/79* | (2015.01) |
| *E05F 17/00* | (2006.01) |

(52) U.S. Cl.

CPC ..... *E06B 7/092* (2013.01); *E06B 3/5036* (2013.01); *E05F 15/71* (2015.01); *E05F 15/77* (2015.01); *E05F 15/79* (2015.01); *E05F 17/00* (2013.01)

(58) Field of Classification Search

CPC ..... E06B 7/092; E06B 3/5036; E05F 15/71; E05F 17/00; E05F 15/79; E05F 15/77

See application file for complete search history.

(56) References Cited

U.S. PATENT DOCUMENTS

| | | | | |
|---|---|---|---|---|
| 2,366,339 A * | 1/1945 | Kump, Jr. | ..... | E06B 7/084 49/64 |
| 2,561,846 A * | 7/1951 | Curry | ..... | E06B 7/084 160/91 |
| 2,758,345 A | 8/1956 | White | | |
| 3,110,937 A | 11/1963 | Naslund | | |
| 4,279,240 A | 7/1981 | Artusy | | |
| 4,493,342 A * | 1/1985 | Bachmann | ..... | F16K 1/165 137/601.06 |
| 4,813,183 A | 3/1989 | Jordal | | |

(Continued)

FOREIGN PATENT DOCUMENTS

| | | |
|---|---|---|
| AU | 2015204391 A1 | 7/2015 |
| EP | 2785945 A1 | 10/2014 |

(Continued)

OTHER PUBLICATIONS

"New Rain Sensor for Automated Window and Vent Closing", PR Newswire, Hydreon Corporation, Jan. 11, 2013, 1 page.

*Primary Examiner* — Katherine W Mitchell
*Assistant Examiner* — Abe Massad
(74) *Attorney, Agent, or Firm* — Stoel Rives LLP

(57) ABSTRACT

A twin louver bank window assembly for efficient thermal control, the assembly including an assembly surround frame including a head member, a sill member and at least a pair of opposed side channel members and a pair of louver banks mounted relative to the assembly surround frame, each louver bank including a number of louvers, one louver bank located towards an outer side of the assembly surround frame and one louver bank located toward an inner side of the assembly surround frame.

19 Claims, 8 Drawing Sheets

(56) References Cited

U.S. PATENT DOCUMENTS

| | | | | |
|---|---|---|---|---|
| 5,379,551 | A * | 1/1995 | Swapp | E06B 7/084 49/74.1 |
| 6,378,248 | B1 | 4/2002 | Jordal | |
| 6,655,091 | B1 | 12/2003 | Iwasaki | |
| 7,434,353 | B2 * | 10/2008 | Nien | E06B 7/086 49/403 |
| 8,528,621 | B2 | 9/2013 | Murphy, Jr. et al. | |
| 8,567,124 | B2 | 10/2013 | Alexander | |
| 8,814,374 | B2 * | 8/2014 | Van Der Poel | E06B 9/30 362/1 |
| 8,881,456 | B2 * | 11/2014 | Xu | E06B 9/264 49/64 |
| 2015/0348401 | A1 * | 12/2015 | Hall | G01R 19/0092 340/12.54 |
| 2016/0032642 | A1 * | 2/2016 | Rotchell | E06B 7/086 49/82.1 |

FOREIGN PATENT DOCUMENTS

| | | | | |
|---|---|---|---|---|
| GB | 2252349 | A | | 8/1992 |
| JP | 11062422 | A | | 3/1999 |
| JP | 2009249960 | A | | 10/2009 |
| KR | 20040092401 | A | * | 11/2004 |
| WO | WO 2004/079141 | A1 | | 9/2004 |
| WO | WO 2017/024354 | A1 | | 2/2017 |

* cited by examiner

TWIN LOUVER WINDOW ASSEMBLY FOR EFFICIENT THERMAL CONTROL

RELATED APPLICATIONS

This application claims priority under 35 U.S.C. § 119 to Australian Provisional Patent Application No. 2016901343, tided TWIN LOUVER ASSEMBLY FOR EFFICIENT THERMAL CONTROL, filed on Apr. 11, 2016, which is incorporated herein by reference in its entirety.

TECHNICAL FIELD

The present disclosure relates generally to louver window assemblies and particularly to a louver window assembly providing greater flexibility in opening and closing conditions for more efficient thermal control.

BACKGROUND ART

A louver is an external window assembly with horizontal slats that are angled to admit light and air, but to keep out rain, direct sunshine, and noise. The angle of the slats may be adjustable or fixed. The louver window assembly can be opened and closed generally by pivoting the louver blades, which is normally performed with a common operating bar mechanism in order to move all of the blades by the same amount, at the same time, and in the same direction.

Louver blades can be made of any one or more of a variety of materials including glass, timber or aluminium and as such, the style of louver windows can be part of any room or design concept.

Louver windows are now used extensively in many buildings due to their ability to be open but still provide security. When opened, the louvers allow airflow through the building structure for thermal management.

Further, although numerous solutions have been posed in the past to varying levels of success, sealing a louver window is quite often problematic.

It will be clearly understood that, if a prior art publication is referred to herein, this reference does not constitute an admission that the publication forms part of the common general knowledge in the art.

SUMMARY

The present disclosure is directed to a twin louver window assembly, which may at least partially overcome at least one of the abovementioned disadvantages or provide the consumer with a useful or commercial choice.

With the foregoing in view, in one form a twin louver bank window assembly for efficient thermal control includes an assembly surround frame including a head member, a sill member and at least a pair of opposed side channel members and a pair of louver banks mounted relative to the assembly surround frame, each louver bank including a number of louvers, one louver bank located towards an outer side of the assembly surround frame and one louver bank located toward an inner side of the assembly surround frame.

Another aspect is how the system of the present disclosure mitigates formation of a pressure differential between the two windows to improve water resistance performance. One or more discrete or unobtrusive openings may be provided somewhere in relation to the outer louver bank that would relieve the pressure between the two louver banks. The outer louver bank could then effectively "shield" the inner louver bank and prevent any pressure build up that may operate to force water through the inner louver bank by allowing the pressure on the outside of the louver system to equalize with the pressure between the louver banks. The one or more openings are preferably located in a weatherseal mount, relative to which a normally resilient weatherseal strip is provided and against which the topmost louver in the moveable louver bank seals when moved into the closed condition.

The pair of louver banks are preferably mounted to the same assembly surround frame.

So as to avoid confusion, in the context of the present disclosure, the term "outer" is directed towards the side of the surround frame oriented towards the outside or weather side of the structure, and the term "inner" is directed towards that side of the surround frame oriented toward the interior of the building.

The twin louver bank window assembly of the present disclosure includes an inner louver bank and an outer louver bank. The respective inner louver bank and outer louver bank can have louver blades which are the same as one another or different to one another. Typically, the inner louver bank and the outer louver bank will each be made up of a number of blades which are the same as those in each louver bank, but the louver blades in the inner louver bank may differ in type from those in the outer louver bank. In one preferred configuration, the louver blades in the outer louver bank may be opaque louver blades and the louver blades in the inner louver bank will be glass louver blades.

The combination of different louver blade types in the different louver banks allows a dramatic increase in the variety of opening configurations available to the client and those different opening configurations in turn lead to a number of advantages in terms of efficient thermal management of the building.

The twin bank louver assembly of the present disclosure is capable of operation in a number of different modes in order for more efficient thermal control of the building including (but not limited to):

1. Natural ventilation mode—open both louver banks;
2. Natural ventilation mode with Shading Mode—optimise shading from an opaque external blade and still provide natural ventilation by having both louver banks open;
3. Passive warming mode—Use the sun's rays to passively warm a building—open louvers in external louver bank over 90 degrees to direct and or reflect the sun's rays into the building;
4. Vent mode—night purge building by opening louvers to vent upwardly;
5. Noise Control mode—manage noise at peak times—close external blades or angle blades to reflect noise away or close all blades;
6. Passive daylight mode—optimises natural daylight and other thermal needs; and
7. Privacy mode—close external solid blades.

In some embodiments, the window assembly will be a powered louver window assembly and will typically include at least one drive or motor associated with each louver bank in order to drive the louver blades in each of the louver banks, between the closed condition and a number of open conditions and vice versa.

The assembly surround frame is normally generally rectangular, formed from a number of members connected to one another or relative to one another to define a central opening within which the louver banks are located and the operation of the louver banks can close the opening. As mentioned, the surround frame includes at least one head member, at least one sill member and at least a pair of opposed side channel members. The surround frame may include a number of louver bays and if that is the case, one or more intermediate mullion members which extend substantially parallel to the side channel members are typically provided separating the bays from one another. The phrase "louver bay" is normally used to in circumstances where a number of sets of louver blades are located side by side One or more of each of the head member, sill member, and side channel member can be provided. In other words, the head of the surround frame may be formed from a number of head members connected to one another or relative to one another, as may the other members in the surround frame.

The members can be connected to one another or relative to one another in any way. The members can be square cut or mitre cut.

It is preferred that any drive or motor provided to open and close the louver banks be provided in the head member and an appropriate drive transfer mechanism provided to connect the drive or motor to the mechanism for opening and closing the louver blades. Typically, one drive or motor will be provided for each louver bank.

The louver banks themselves are each typically provided with an opening and closing mechanism and any opening and closing mechanism can be used. According to a preferred embodiment, one or more louver operating bars are typically provided located within or partially within the respective side channel members. Normally, at least one louver operating bar is provided on each lateral side of each bank of louvers and preferably, a pair of louver operating bars is provided on each lateral side. Louver operating bars are described in detail with respect to a single louver bank in WO 2017/024354, titled AN ENHANCED POWER WINDOW ASSEMBLY, which is incorporated herein by reference in its entirety. As will be apparent to one skilled in the art, in a twin-louver window assembly according to the present disclosure, each bank of louvers may have a similar operating bar.

Each louver blade is typically mounted relative to the respective side channel members via a louver end clip which attaches to the louver blade and a bearing is associated with each louver end clip. Typically, each bearing is located on inside of the side channel members and the bearing engages with the one or more louver operating bars within the channel. In use, reciprocation of the louver operating bars will normally cause rotation of the bearings associated with each of the louver blades in the louver bank which in turn causes rotation of the end clips and the louver blades mounted thereto.

The assembly surround frame and the members forming the assembly surround frame, may be manufactured from any material but a metal material, preferably a light metal material such as aluminium is preferred.

The assembly surround frame and in particular, the side channel members of the assembly surround frame will preferably have a pair of spaced apart bearing mount portions through which the bearings for each of the louvers in a respective louver bank are mounted. The spaced apart bearing mount portions are typically spaced across the depth of the surround frame and in particular, it is preferred that one inner bearing mount portion is provided and one outer bearing mount portion is provided. The bearing mount portions are typically spaced from one another to take into account the height of the louver blades in the window assembly. It is particularly preferred that the bearing mount portions are spaced to allow rotation of the louver blades past horizontal or at least rotation of louver blades such that the louver blades of one of the louver banks do not strike the louver blades of the other louver bank during the opening and closing process, even if the louver blades are opened through more than 90°.

At least one of the louver banks may have a restricted opening size in order to restrict the "gap" between adjacent louver blades in the same bank of louvers, in the open position.

The window assembly also includes a pair of louver banks mounted relative to the assembly surround frame, each louver bank including a number of louvers, one louver bank located towards an outer side of the assembly surround frame and one louver bank located toward an inner side of the assembly surround frame. Each louver bank is typically designated as a group of louver blades with the bearing mounting the louver blades located in the same plane, typically a substantially vertical plane. In other words, all of the bearings in a particular louver bank are aligned, substantially vertically.

As mentioned, the louver banks are typically spaced across the depth of the frame with one located towards an inner side and one located towards an outer side. The respective inner and outer louver banks will normally have the same number of louver blades but the number and configuration of louver blades in each louver bank may differ. For example, providing a smaller number of louver blades in the outer louver bank will typically result in the louver blades being taller in height and the provision of a higher number of lesser height louver blades in the inner louver blank may assist with providing clearance between the louver blades to allow rotation through more than 90°, particularly of the shorter louver blades without striking the taller louver blades. Of course, this configuration can be reversed with the taller blades on the inside and the smaller blades on the exterior. A more preferred configuration is having louver blades in each of the respective banks which are substantially the same dimension and spaced appropriately.

The louver blades can be manufactured from different materials. The materials can typically be a transparent material such as glass or plastic (which may be tinted or coloured or not), or an opaque material such as wood or metal. Under some circumstances, one or more louver blades may be provided with a (relatively) high reflectivity surface or made from a (relatively) high reflectivity material in order to utilise the louver blades to reflect light into a building. The louver blades can be solid or hollow.

The louver banks will typically open and close independently of one another and be actuable in this way by a user. The louver banks may be independently actuable or actuable in combination. In this way, the user can choose to open and/or close one or the other of the louver banks or can open and/or close both louver banks together.

As mentioned above, at least one, and typically both of the louver banks will preferably operate according to a powered opening and/or closing mechanism. The opening and/or closing mechanism may have one or more sensors or control systems associated therewith in order to open and/or close one or more of the louver banks in order to manage heat and/or ventilation in a building whilst preventing inclement weather from entering the building and also being sensitive to other weather phenomena and such as high wind days. In particular, a temperature sensor can be provided, rain sensor can be provided and/or a wind sensor can be provided in order to control opening and/or closing of the louver banks according to the prevailing weather conditions and to more efficiently manage thermal operation of the building.

Any sensor may be located on the outside of the assembly. In some embodiments there is more than one sensor, for example, a temperature sensor provided between the two louver banks as this allows the control unit to determine a temperature difference between the inside and outside and drive the louver blades accordingly. In some embodiments, the temperature sensor is provided inside of the controller. A separate, outside temperature sensor that communicates with the controller may also be provided to enhance system functionality.

As mentioned above, any number of louvers may be provided in either louver bank. The louver blades in one bank may be staggered or offset from the louver blades in the other bank, normally around the rotation centres being the bearings. Preferably however the axis of rotation for each of the louver blades on each of the inner louver bank and the outer louver bank are aligned not only vertically, but substantially horizontally as well.

Louver window assemblies according to the present disclosure may include or be associated with a powered window control system including a control unit associated with the louver window assembly and including at least one wireless communication device to allow communication with a compatible device operating a software application, and a software application operating on a compatible device, the software application allowing input of instructions to control the powered window assembly and communication to the control unit via the at least one wireless communication device of the control unit.

Preferably, the control unit is provided or associated with a wall mounted input panel, switch or panel of switches for input of instructions to the control unit and/or a separate wall mounted input panel, switch or panel of switches can be provided to issue instructions to the control unit.

Preferably, the control unit also allows for automatic operation of the at least one powered window assembly in response to climatic conditions including rain, wind or temperature events, sun position (however determined, for example, using a sensor, calculator, or schedule and provided to a controller), or timer events.

Still further, the control unit will also preferably allow for integration into or use together with building management systems which allow control of the powered window assembly and other automated building products as well as providing automatic operation in response to sensors and inputs other than temperature or timer events. For example, a wind sensor may be included in the system in order to allow the at least one powered window assembly to open and/or close depending upon the amount of wind sensed on an external side of the at least one powered window assembly or a rain sensor to close the window assembly if weather becomes inclement.

The control unit is preferably able to move the louvers in a preset sequence to avoid interference between inner and outer banks of louver blades. For example, fully closing the inner bank while rotating the outer bank to a desired angle, and then rotating the inner bank to a desired angle.

Still further, the system may be provided with a battery backup or uninterrupted power supply (UPS) to allow operation of the louver banks, at least temporarily, when there is a power outage. This will preferably allow open louvers to be closed and closed louvers to be opened even when there is an interruption in the main power supply.

When power is supplied after an interruption, the system of the present disclosure may automatically reset the louver banks to the closed position. The system may be capable of determining and recording when the window is fully closed and fully open and any intermediate positions, e.g. 30% open. A method that effectively counts the number of motor revolutions to determine the blade position may be used to ascertain the intermediate position of one or both of the louver banks can be used.

A system according to the present disclosure will either operate in association with or include at least one powered window assembly. The powered window assembly may have any type. For example, a particularly preferred window assembly configuration to which the present disclosure is applicable, is a louver window assembly. However, the present disclosure could also be readily adaptable to roof windows, skylights, elevated windows, vent windows, awning windows and/or casement windows.

The window assembly may be a single bay window assembly or multiple bay window assembly. More than one window assembly may be controlled using the same control unit. Further, only a portion of the window panels in a window assembly may be controlled using a control unit. This may particularly be the case where a tall bay of louver windows are controlled by one control unit controlling an upper region of the louvers in the bay and one or more other control units controlling other portions of the louvers in the bay.

It is particularly preferred that the window assembly will typically be provided in a window surround frame with all components of the window including the opening and closing mechanism mounted relative to the surround frame. Typical components of the opening and closing mechanism will include a motor unit, one or more transformers, any type of rod or other linking systems that are part of the assembly. According to a particularly preferred embodiment, the window assembly used according to the present disclosure will typically be installed in a single unit, preferably requiring connection to a power source only and/or installation of a wall plate control unit if required.

The window assembly may have any type of motor and/or opening and closing system including chain drive, rod linkage, worm drive, gear system or be screw driven.

The system includes at least one control unit. The control unit may be provided with the window assembly and mounted into or with the window assembly but preferably, the control unit will be provided separately thereto but in association with the window assembly. According to a particularly preferred embodiment, the control unit will preferably be mounted as a part of a wall mounted control unit, typically in the same room as the window assembly (ies) to be controlled.

Preferably, the wall mounted control unit will have a wall plate, similar in size and shape to a conventional light switch. It is preferred that the wall plate be provided with touch sensitive buttons to allow operation of the window assembly.

The control unit may have any number of operating channels and can be single channel or multichannel.

The control unit may be adapted to open the window panels in the window assembly, close the panels in the window assembly, as well as open or close the window panels to one or more intermediate positions. Typically, the intermediate positions may be preset either by a manufacturer or operator. In some embodiments, the control unit is adapted to open and close the louvers in a preset sequence to avoid interference between the inner and outer banks of the louver blades.

The control unit of some embodiments includes a wireless communication device to allow communication with and control by a compatible device operating a software application. Bluetooth is a preferred method of wireless communication but any portion of the electromagnetic spectrum can be used. This will typically allow a compatible device to operate as a remote control to control the window assembly as required. The software application operating on the compatible device will typically allow the user to set and maintain set points such as temperatures, control the timer functionality where provided and also to set and maintain any preset intermediate positions for the window panel(s) within the window assembly.

The software application will also preferably allow for other sensor inputs to be received and be used to control the window assembly. The software application will typically display information to the user and allow automated activation to be controlled via the software application and then control instructions can be communicated to the control unit.

Control of a window assembly utilising the system of the present disclosure can be directly applied through the user interaction with the switches on the preferred wall plate but can also normally be implemented through instructions stored in the software application which when followed, generate one or more interfaces on a personal computing device (PCD) such as a smartphone or tablet computer. The instructions are typically followed, normally by the process of the PCD, in order to generate and update an interface in real time according to the user's interaction with the interface. The user's interaction with the software application through the interface will typically result in the software application issuing control instructions to the control unit using the respective communication devices provided on the personal computing device and the control unit.

The personal computing device can be of any type such as a tablet or computer or the like but will preferably be a smartphone or other similar device which is carried by a person and is therefore easily accessible to them at the majority of times. The personal computing device of the preferred embodiment will include a processor having an associated memory for storing instructions and a display upon which an interface can be generated and displayed allowing user interaction with the software application. As mentioned above, the personal computing device will typically include a wireless communication device and normally, personal computers and devices such as those discussed above have access to a number of communications pathways such that information can be transmitted and received via any one or more of a variety of communications pathways. These communications pathways typically include Wi-Fi, Bluetooth as well as telecommunications networks and data links or RFID but any portion of the electromagnetic spectrum could be used. According to the most preferred embodiment, the system of the present disclosure will operate via Bluetooth.

Many of these PCDs have touchscreens for display, allowing the user to directly interact with the touchscreen in order to interact with the interface. However, a non-touchscreen display can be used with a movable pointer or selection tool in order to allow a user to interact with the interface.

One or more "buttons" are provided on the interface to allow the user to interact with the PCD and through the PCD, to interact with the system. These are typically portions on the interface allowing a user to input instructions and actions via software operating on the PCD.

Any of the features described herein can be combined in any combination with any one or more of the other features described herein within the scope of the disclosure.

The reference to any prior art in this specification is not, and should not be taken as an acknowledgement or any form of suggestion that the prior art forms part of the common general knowledge.

BRIEF DESCRIPTION OF DRAWINGS

Preferred features, embodiments and variations of the embodiments may be discerned from the following Detailed Description which provides sufficient information for those skilled in the art to perform the disclosure. The Detailed Description is not to be regarded as limiting the scope of the preceding Summary in any way. The Detailed Description will make reference to a number of drawings as follows.

DESCRIPTION OF EMBODIMENTS

Figure 1:
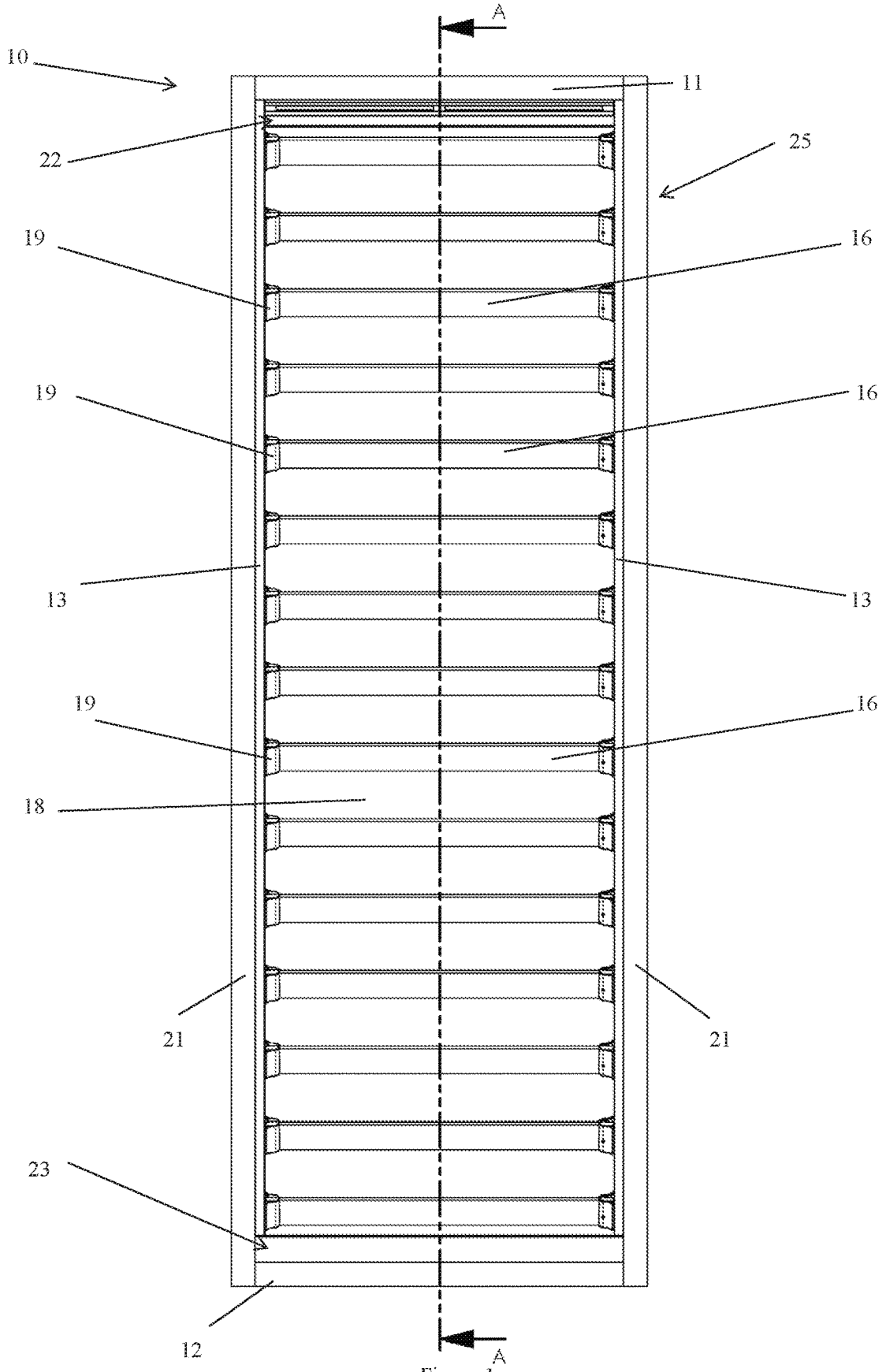
FIG. 1 is a front elevation view of a twin louver bank window assembly according to an embodiment.

According to a particularly preferred embodiment, a twin louver bank window assembly is provided.

The twin louver bank window assembly 10 illustrated in the accompanying Figures includes an assembly surround frame including a head member 11, a sill member 12 and a pair of opposed side frame members 21 to which one of a pair of side channel members 13 are mounted and a pair of louver banks, one inner louver bank 14 and one outer louver bank 15 mounted relative to the assembly surround frame, each louver bank including a number of louver blades 16. An upper sealing assembly is provided 22 and a lower sealing assembly 23 is also provided.

One possible aspect is the creation of a pressure differential between the two windows to improve water resistance performance. A discrete opening is preferably provided somewhere in relation to the outer louver bank that would relieve the pressure between the two louver banks. The outer louver bank could then effectively "shield" the inner louver bank and prevent any pressure build up that may operate to force water through the inner louver bank. In some embodiments, the discrete opening is provided in relation to the outer louver bank and a second discrete opening is provided in relation to the inner louver bank to allow air to pass between the outside and inside to equalize the pressure.

Figure 2:
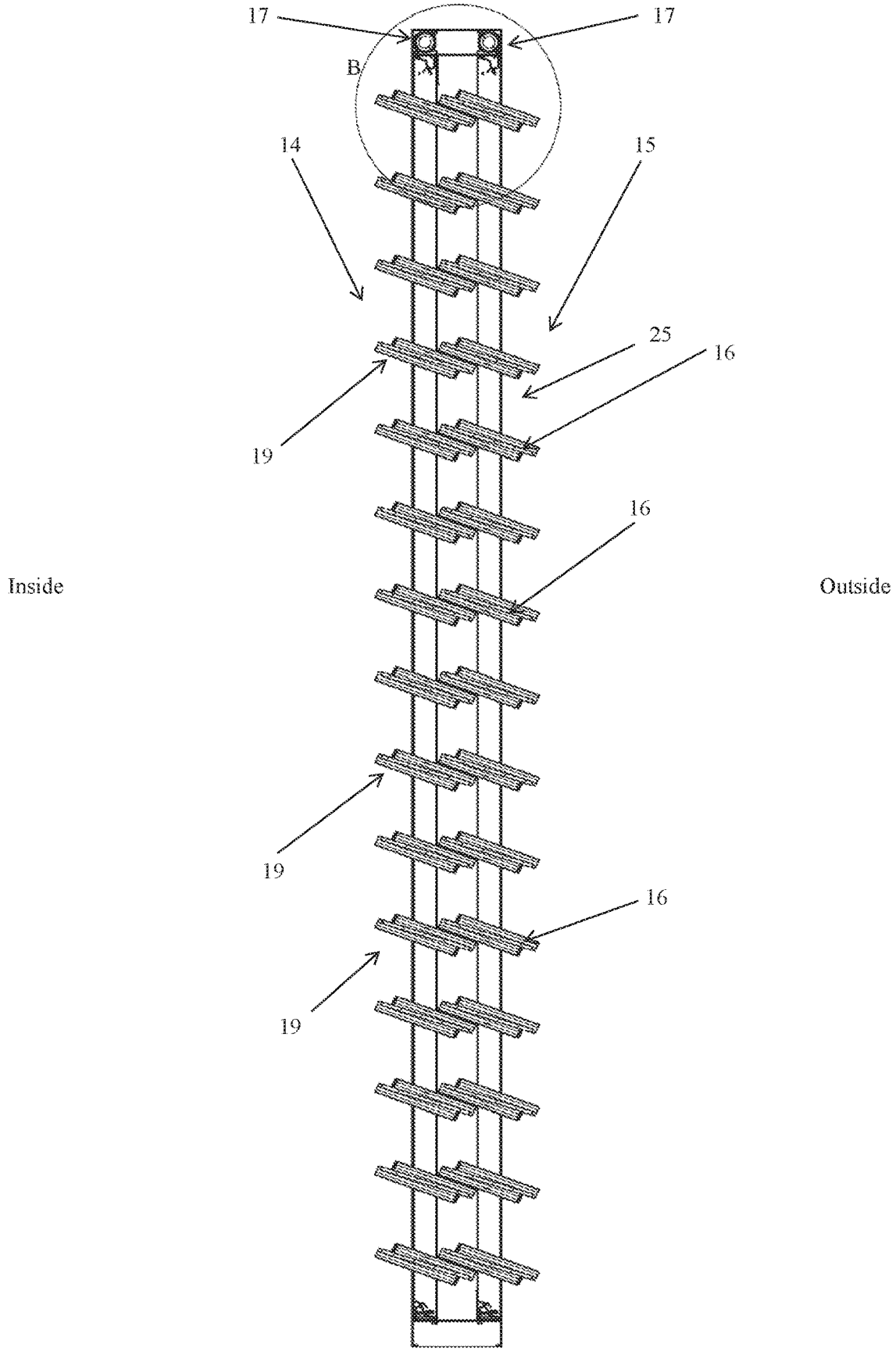
FIG. 2 is a sectional side elevation view of assembly illustrated in FIG. 1 in the open condition and taken along line A-A.
Figure 3:
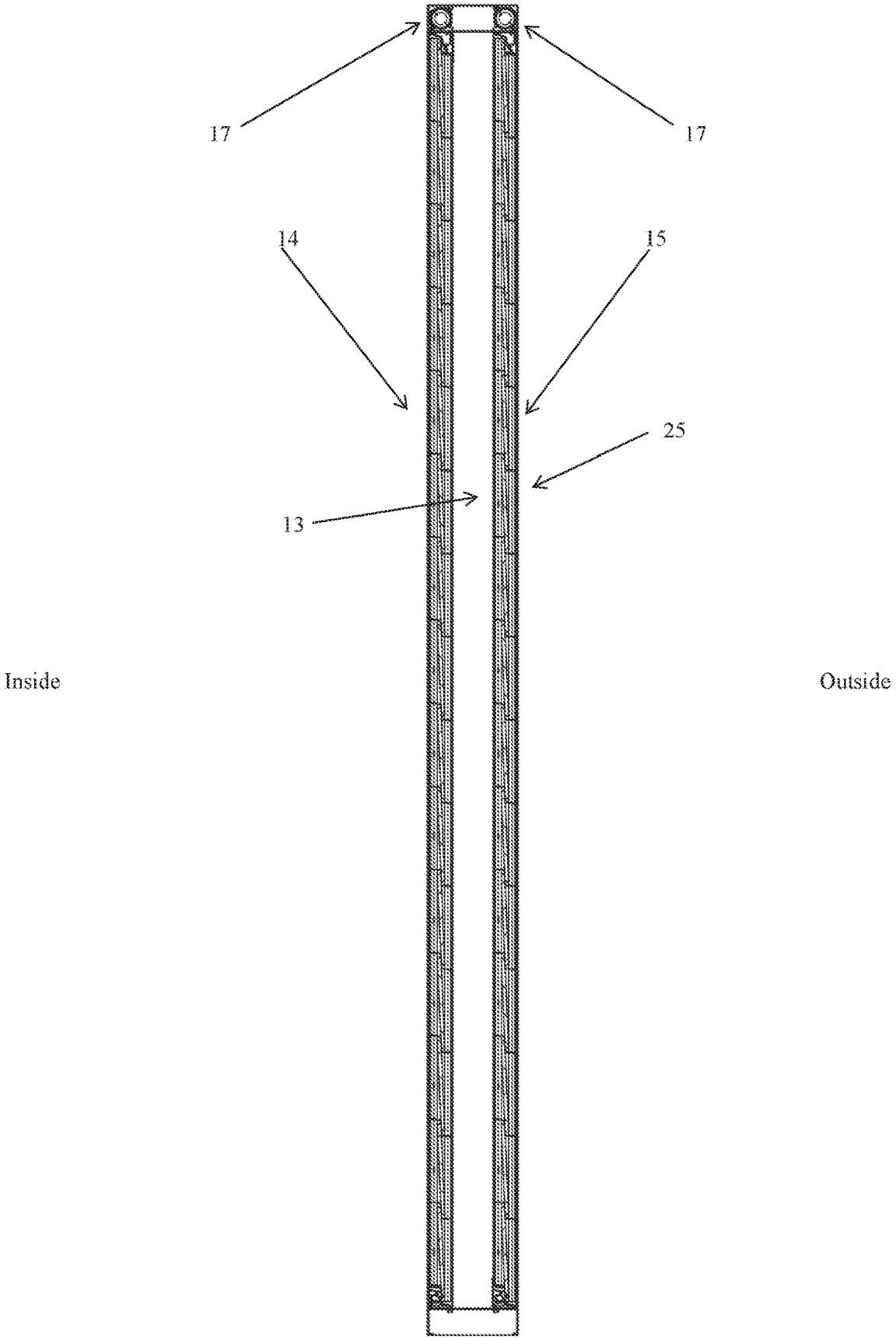
FIG. 3 is a sectional side elevation view of the assembly illustrated in FIG. 1 in the closed condition and taken along line A-A.

The pair of louver banks are preferably mounted to the same assembly surround frame as illustrated in FIGS. 2 and 3.

So as to avoid confusion, in the context of the present disclosure, the term "outer" is directed towards the side of the surround frame oriented towards the outside or weather side of the structure, and the term "inner" is directed towards that side of the surround frame oriented toward the interior of the building.

The twin louver bank window assembly 10 includes an inner louver bank 14 and an outer louver bank 15. The respective inner louver bank 14 and outer louver bank 15 can have louver blades which are the same as one another or different to one another. Typically, the inner louver bank 14 and the outer louver bank 15 will each be made up of a number of louver blades 16 which are the same as the other louver blades in the same louver bank, but the louver blades in the inner louver bank 14 differ in type from those in the outer louver bank 15. In one preferred configuration, the louver blades in the outer louver bank 15 are opaque louver blades and the louver blades in the inner louver bank 14 are glass louver blades.

The combination of different louver blade types in the different louver banks allows a dramatic increase in the variety of opening configurations available to the client and those different opening configurations in turn lead to a number of advantages in terms of efficient thermal management of the building.

The twin bank louver assembly 10 is capable of operation in a number of different modes, typically pre-determined or pre-programmed, in order for more efficient thermal control of the building including (but not limited to):

1. Natural ventilation mode—open both louver banks;
2. Natural ventilation mode with Shading Mode—optimise shading from an opaque external blade and still provide natural ventilation by having both louver banks open;
3. Passive warming mode—Use the sun's rays to passively warm a building—open louvers in external louver bank over 90 degrees to direct and or reflect the sun's rays into the building;
4. Vent mode—night purge building by opening louvers to vent upwardly;
5. Noise Control mode—manage noise at peak times—close external blades or angle blades to reflect noise away or close all blades;
6. Passive daylight mode—optimises natural daylight and other thermal needs; and
7. Privacy mode—close external solid blades.

Generally, the window assembly 10 will be a powered louver window assembly and a drive or motor 17 will be associated with each louver bank in order to drive the louver blades 16 in each of the louver banks, between the closed condition and a number of open conditions and vice versa.

As illustrated in FIG. 1, the assembly surround frame 25 is normally generally rectangular, formed from a number of members connected to one another or relative to one another to define a central opening 18 within which the louver banks are located and the operation of the louver banks can close the opening. As mentioned, the surround frame 25 includes a head member 11, a sill member 12 and a pair of opposed side channel members 13.

One or more of each of the head member 11, sill member 12, and side channel member can be provided. In other words, the head of the surround frame 25 may be formed from a number of head members connected to one another or relative to one another, as may the other members in the surround frame 25.

Figure 4:
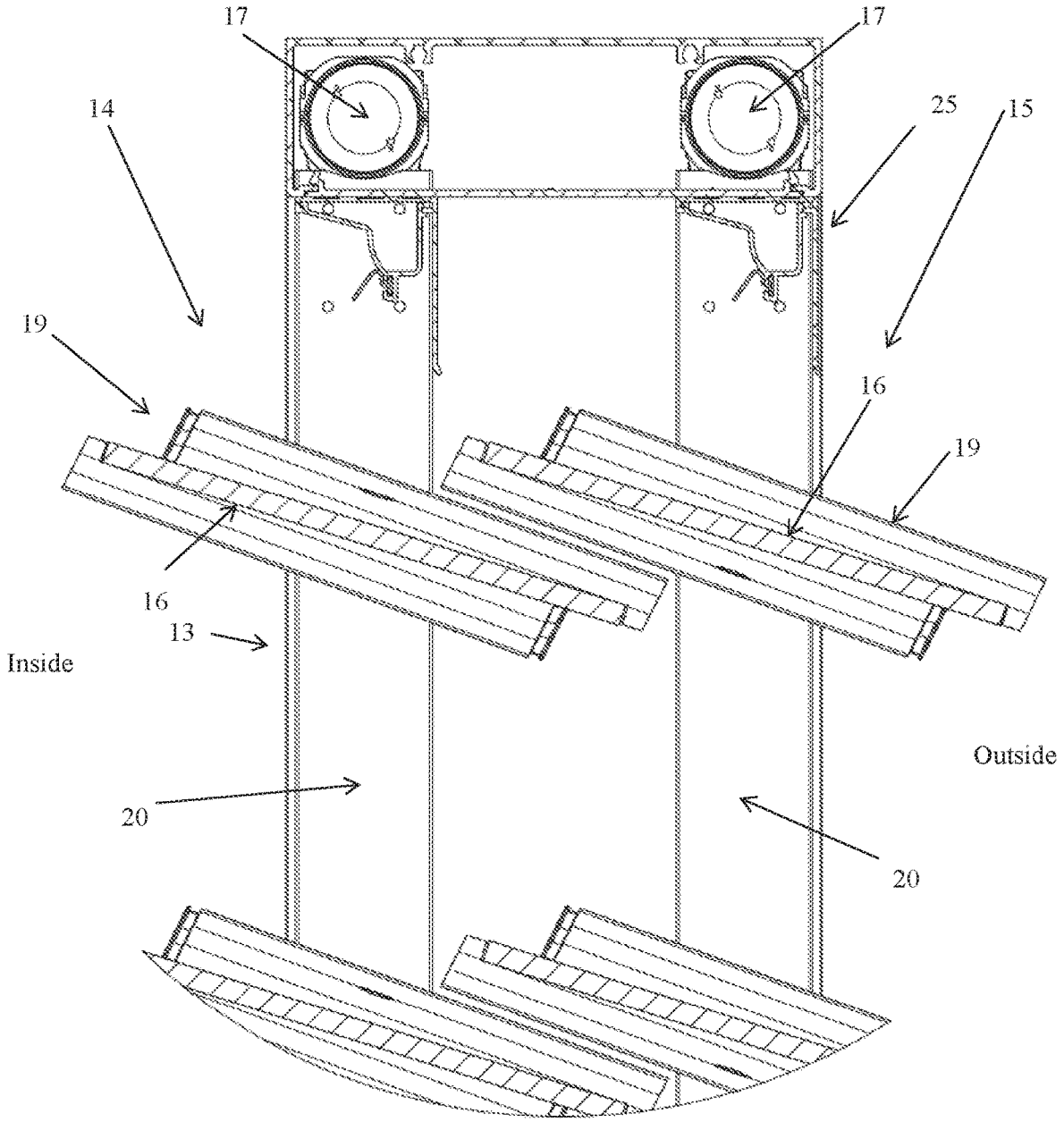
FIG. 4 is a more detailed view of the portion identified by reference letter "B" in FIG. 2.
Figure 5:
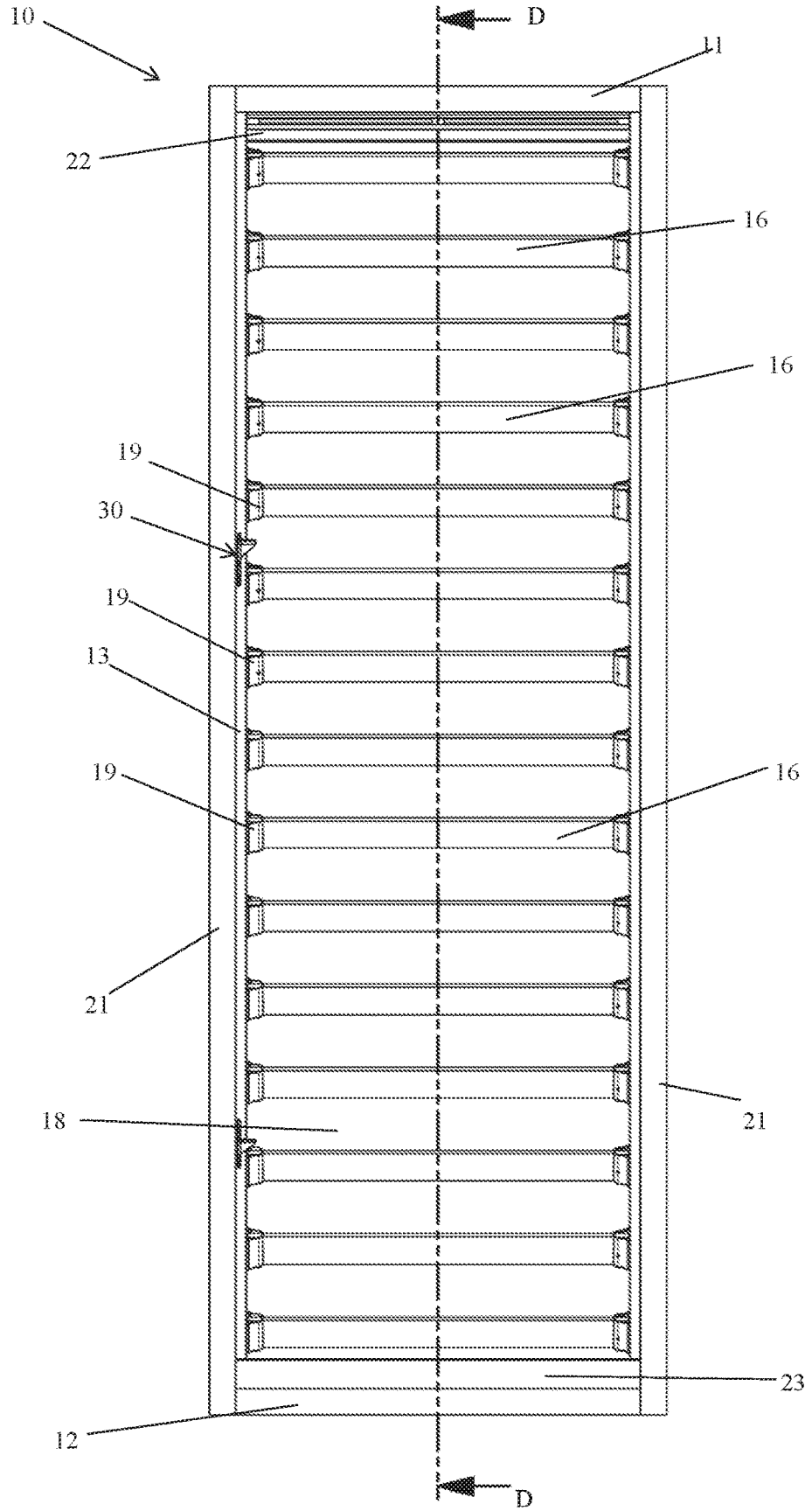
FIG. 5 is a front elevation view of a twin louver bank window assembly according to a second preferred embodiment.
Figure 6:
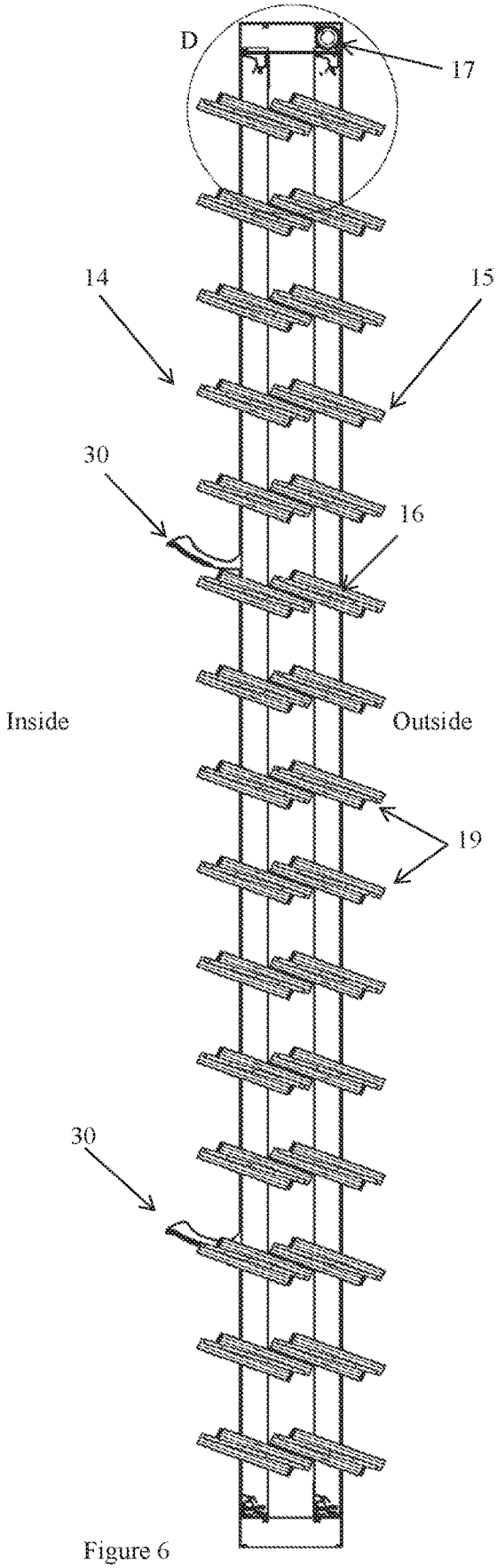
FIG. 6 is a sectional side elevation view of the assembly illustrated in FIG. 5 in the open condition and taken along line D-D.
Figure 7:
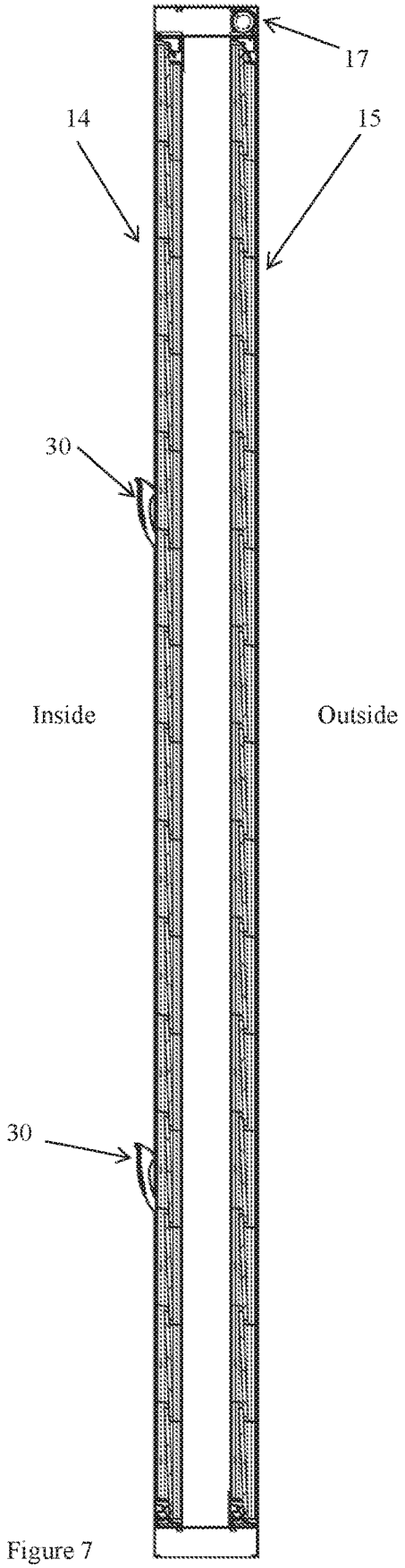
FIG. 7 is a sectional side elevation view of the assembly illustrated in FIG. 5 in the closed condition and taken along line D-D.
Figure 8:
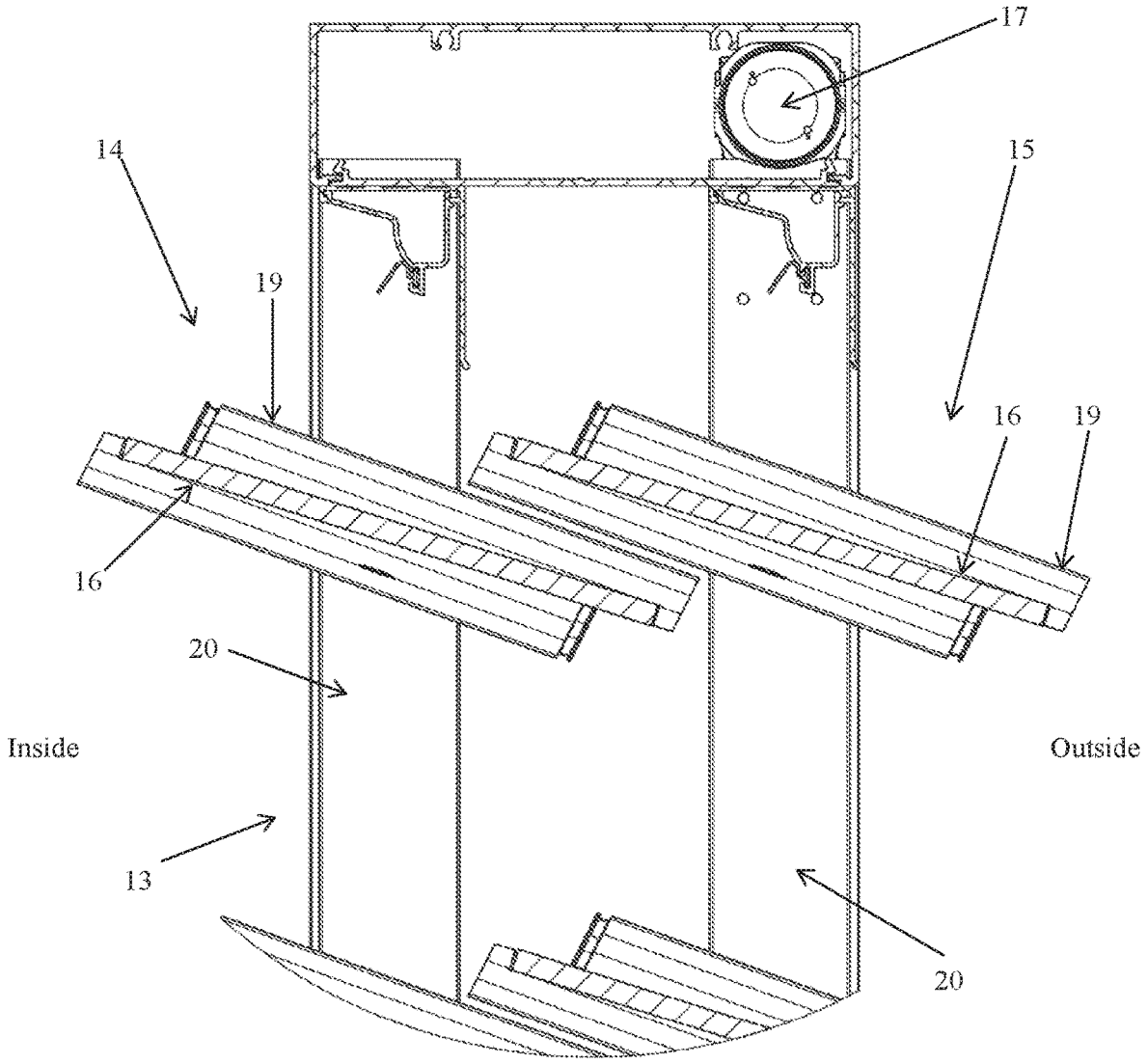
FIG. 8 is a more detailed view of the portion identified by reference letter "D" in FIG. 6.

It is preferred that the drive or motor 17 provided to open and close the louver banks be provided at least partially within the head member 11 and an appropriate drive transfer mechanism provided to connect the drive or motor 17 to the mechanism for opening and closing the louver blades. Typically, at least one drive or motor will be provided for each louver bank as shown in FIGS. 2 to 4. More than one motor per louver bank may be provided and this will occur when the louver bank has a larger number of blades. In other words, each motor may only power a certain number of blades and if more blades are provided in any one bank, more than one motor will generally be provided. In FIG. 4, the louvers are opened to an angle where the louver clip is approximately 70° relative to the frame.

The louver banks themselves are each typically provided with an opening and closing mechanism and any opening and closing mechanism can be used. According to a preferred embodiment, one or more louver operating bars are typically provided located within or partially within the respective side channel members. Normally, at least one louver operating bar is provided on each lateral side of each bank of louvers and preferably, a pair of louver operating bars is provided on each lateral side.

Each louver blade is typically mounted relative to the respective side channel 13 members via a louver end clip 19 which attaches to the louver blade 16 and a bearing is associated with each louver end clip mounted relative to the side channel. Typically, each bearing is located on inside of the side channel members and the bearing engages with the louver operating bars within the channel 13. In use, reciprocation of the louver operating bars will normally cause rotation of the bearings associated with each of the louver blades 16 in the louver bank which in turn causes rotation of the end clips 19 and the louver blades 16 mounted thereto.

The assembly surround frame 25 and the members forming the assembly surround frame 25, may be manufactured from any material but a metal material, preferably a light metal material such as aluminium is preferred.

The assembly surround frame 25 and in particular, the side channel members 13 of the assembly surround frame 25 have a pair of spaced apart hearing mount portions 20 through which the bearings for each of the louvers blades 16 in a respective louver bank are mounted. The spaced apart bearing mount portions of the preferred embodiment are spaced across the depth of the surround frame 25 and in particular, it is preferred that one inner bearing mount portion is provided and one outer bearing mount portion is provided. The bearing mount portions are typically spaced from one another to take into account the height of the louver blades in the window assembly. It is particularly preferred that the bearing mount portions are spaced to allow rotation of the louver blades past horizontal or at least rotation of louver blades such that the louver blades of one of the louver banks do not strike the louver blades of the other louver bank during the opening and closing process, even if the louver blades are opened through more than 90°.

Alternatively and as illustrated, the louver banks may have a restricted opening size in order to restrict the "gap" between adjacent louver blades in the same bank of louvers, in the open position.

In the illustrated embodiment, each louver bank is typically designated as a group of louver blades 16 with the bearing mounting the louver blades 16 located in the same substantially vertical plane. In other words, all of the bearings in a particular louver bank are aligned, substantially vertically.

The respective inner louver bank 14 and outer louver bank 15 will normally have the same number of louver blades 16 as illustrated but the number and configuration of louver blades in each louver bank may differ.

The louver blades 16 can be manufactured from different materials. The materials can typically be a transparent material such as glass or plastic (which may be tinted or coloured or not), or an opaque material such as wood or metal. Under some circumstances, one or more louver blades may be provided with a (relatively) high reflectivity surface or made from a (relatively) high reflectivity material in order to utilise the louver blades to reflect light into a building. The louver blades can be solid or hollow.

The louver banks 14, 15 will typically open and close independently of one another and be actuable in this way by a user. The louver banks may be independently actuable or actuable in combination. In this way, the user can choose to open and/or close one or the other of the louver banks or can open and/or close both louver banks together.

As mentioned above, at least one, and typically both of the louver banks operate according to a powered opening and/or closing mechanism. The opening and/or closing mechanism may have one or more sensors or control systems associated therewith in order to actuate the drive or motor 17 to open and/or close one or more of the louver banks in order to manage heat and/or ventilation in a building whilst preventing inclement weather from entering the building and also being sensitive to other weather phenomena such as high wind days. In particular, a temperature sensor can be provided, rain sensor can be provided and/or a wind sensor can be provided in order to control opening and/or closing of the louver banks according to the prevailing weather conditions and to more efficiently manage thermal operation of the building.

In the preferred embodiment, the axis of rotation for each of the louver blades on each of the inner louver bank and the outer louver bank are aligned not only vertically, but substantially horizontally as well.

The louver window assembly of the present disclosure may include or be associated with a powered window control system including a control unit associated with the louver window assembly and including at least one wireless communication device to allow communication with a compatible device operating a software application, and a software application operating on a compatible device, the software application allowing input of instructions to control the powered window assembly and communication to the control unit via the at least one wireless communication device of the control unit.

An alternative configuration is illustrated in FIGS. 5 to 8. The alternative configuration is similar to the configuration illustrated in FIGS. 1 to 4 with one main difference in that the outer louver bank is a powered louver bank having a drive 17 mounted relative to the head of the surround frame 25 and the inner louver bank is manually actuated with one or more handles 30 mounted relative to the side frame member to allow a user to manually open and close the inner louver bank. In another alternative configuration, the inner louver bank is a powered louver bank having a drive 17 mounted relative to the head of the surround frame 25 and the outer louver bank is manually actuated with one or more handles 30 mounted relative to the side frame member to allow a user to manually open and close the outer louver bank.

Figure 9:
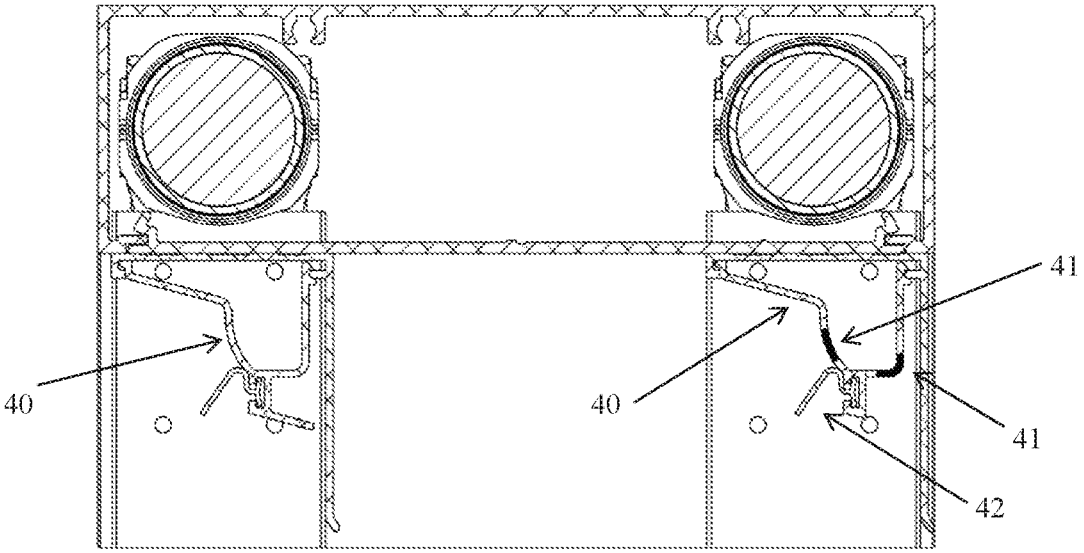
FIG. 9 is a more detailed view of an upper portion of the louver bank window assembly.

FIG. 9 shows another aspect of how the system of the present disclosure mitigates formation of a pressure differential between the two windows to improve water resistance performance. One or more discrete or unobtrusive openings are provided in relation to the outer louver bank that relieves the pressure between the two louver banks. The outer louver bank can then effectively "shield" the inner louver bank and prevent any pressure build up that may operate to force water through the inner louver bank by allowing the pressure on the outside of the louver system to equalize with the pressure between the louver banks. For example in FIG. 9, a pair of openings 41 are located in a weatherseal mount 40, relative to which a normally resilient weatherseal strip 42 is provided and against which the topmost louver in the moveable louver bank seals when moved into the closed condition. The one or more discrete or unobtrusive openings, however, may be provided in other locations within the twin louver window assembly to mitigate formation of the pressure differential.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present disclosure. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

Embodiments have been described in language more or less specific to structural or methodical features. It is to be understood that the disclosure is not limited to specific features shown or described since the means herein described comprises preferred forms of putting the disclosure into effect. The disclosure is, therefore, claimed in any of its forms or modifications within the proper scope of the appended claims (if any) appropriately interpreted by those skilled in the art.

The invention claimed is:

1. A powered twin louver bank window system comprising:

an assembly surround frame, configured to be fitted in a wall envelope of a building, the assembly surround frame including a head member, a sill member, and at least a pair of opposed side channel members, wherein, when the assembly surround frame is installed in the wall envelope of the building, the wall envelope at least in part surrounds the head member, the sill member, and the pair of opposed side channel members leaving an outer side of the assembly surround frame exposed to an exterior environment of the building and an inner side of the assembly surround frame exposed to an interior of the building;

a pair of louver banks mounted relative to the assembly surround frame, including an outer louver bank located towards the outer side of the assembly surround frame and an inner louver bank located toward the inner side of the assembly surround frame, each of the outer and inner louver banks including a plurality of louver blades;

at least one powered drive mechanism associated with one or more of the louver banks to drive at least some of the louver blades of one or more of the louver banks between a closed configuration and one or more open configurations, and the inner louver bank seals when in the closed position to enable a pressure differential to be achieved across the inner louver bank;

a passageway comprising an opening formed in a portion of the assembly surround frame proximate to an upper portion of the outer louver bank that opens to the exterior environment when the assembly surround frame is installed in the wall envelope, the passageway providing passive fluid communication between the exterior environment and a space inside the outer louver bank between the inner and outer louver banks so as to allow pressure equalization across the outer louver bank when the outer louver bank is closed; and a window control system including a control unit operable to automatically control the at least one drive mechanism.

2. The powered twin louver bank window system as claimed in claim 1 wherein the inner and outer louver banks are mounted within the same assembly surround frame.

3. The powered twin louver bank window system as claimed in claim 1 wherein the louver blades in the outer louver bank are at least partially opaque louver blades and the louver blades in the inner louver bank are transparent louver blades.

4. The powered twin louver bank window system as claimed in claim 1 wherein the assembly surround frame includes a plurality of louver bays with one or more intermediate mullion members extending substantially parallel to the side channel members separating the respective louver bays from one another.

5. The powered twin louver bank window system as claimed in claim 1 wherein the louver blades in the inner louver bank and the louver blades in the outer louver bank are manufactured from different materials with the materials chosen to provide different light transmission characteristics to each of the respective inner louver bank and the outer louver bank.

6. The powered twin louver bank window system as claimed in claim 1 wherein the inner louver bank and outer louver bank are actuable to open and close independently of one another.

7. The powered twin louver bank window system as claimed in claim 1 further including a drive mechanism associated with each louver bank to drive at least some of the louver blades in each of the inner and outer louver banks between a closed configuration and a plurality of open configurations.

8. The powered twin louver bank window system as claimed in claim 1 wherein the control unit is configured to control the at least one drive mechanism in a plurality of preset open and close configurations.

9. The powered twin louver bank window system as claimed in claim 8 further including a drive mechanism associated with each louver bank to drive the louver blades in each of the inner and outer louver banks between a closed configuration and a plurality of open configurations, wherein at least one of the preset open and close configurations includes the louver blades in one of the inner and outer louver banks at a different angle than the louver blades in the other of the inner and outer louver banks.

10. The powered twin louver bank window system as claimed in claim 8 further including a drive mechanism associated with each louver bank to drive the louver blades in each of the inner and outer louver banks between a closed configuration and a plurality of open configurations, wherein at least one of the preset open and close configurations includes the louver blades in one of the inner and outer louver banks at the same angle as the louver blades in the other of the inner and outer louver banks.

11. The powered twin louver bank window system as claimed in claim 1, further comprising one or more sensors, and wherein the control unit is responsive to the one or more sensors to open or close one or more of the louver banks to manage heat in a building.

12. The powered twin louver bank window system as claimed in claim 11 wherein one or more of a temperature sensor, a rain sensor or a wind sensor are provided to control opening and/or closing of the one or more louver banks.

13. The powered twin louver bank window system as claimed in claim 1 wherein the at least one drive mechanism has one or more sensors or control systems associated therewith to open and close one or more of the louver banks to manage ventilation in a building whilst preventing inclement weather from entering the building.

14. The powered twin louver bank window system as claimed in claim 13 wherein at least one of a temperature sensor, a rain sensor, a sun position sensor, or a wind sensor are provided to control opening or closing, or both, of the one or more louver banks.

15. The powered twin louver bank window system as claimed in claim 1 wherein the louver blades in one of the respective inner louver bank and outer louver bank are staggered or offset from the louver blades in the other of the respective inner louver bank and outer louver bank.

16. The powered twin louver bank window system assembly as claimed in claim 1 further including at least one wireless communication device to allow communication with a compatible device operating a software application, and a software application operating on the compatible device, the software application allowing input of instructions to control the powered window assembly and communication to the control unit via the at least one wireless communication device of the control unit.

17. The powered twin louver bank window system as claimed in claim 1 wherein the control unit is configured to cause the at least one drive mechanism to drive some of the louver blades in response to a timer event.

18. The powered twin louver bank window system as claimed in claim 1 wherein the at least one powered drive mechanism includes at least one drive motor mounted within the head member.

19. The powered twin louver bank window system as claimed in claim 1 wherein the passageway is formed at least in part in a weatherseal mount of the assembly surround frame.

* * * * *